United States Patent [19]

Thompson et al.

[11] 4,148,253

[45] Apr. 10, 1979

[54] VERTICAL CLOSED CHAMBER BALER

[75] Inventors: Wallace M. Thompson; William D. Beeland, both of Cordele, Ga.

[73] Assignee: American Hoist & Derrick Company, St. Paul, Minn.

[21] Appl. No.: 905,174

[22] Filed: May 11, 1978

Related U.S. Application Data

[62] Division of Ser. No. 717,872, Aug. 26, 1976, Pat. No. 4,102,259.

[51] Int. Cl.[2] ..... B30B 15/08

[52] U.S. Cl. ..... 100/97; 100/215

[58] Field of Search ..... 100/97, 215, 218, 244, 100/249; 83/622; 222/56, 80; 141/95, 198

[56] References Cited

U.S. PATENT DOCUMENTS

| | | | |
|---|---|---|---|
| 1,821,963 | 9/1931 | Clark | 100/97 |
| 2,780,989 | 2/1957 | Guy | 100/244 |
| 2,955,529 | 10/1960 | Marble | 100/244 |
| 2,996,756 | 8/1961 | Korsch | 100/218 |
| 3,095,097 | 6/1963 | Mellow | 222/56 |
| 3,171,447 | 3/1965 | Fowler | 141/198 |

FOREIGN PATENT DOCUMENTS

| | | | |
|---|---|---|---|
| 513076 | 11/1930 | Fed. Rep. of Germany | 100/244 |

*Primary Examiner*—Billy J. Wilhite

*Attorney, Agent, or Firm*—Cushman, Darby & Cushman

[57] ABSTRACT

A baling machine for particulate material such as wood chips and bark includes a vertically elongated compression chamber provided at its upper end with an inclined inlet feed chute, a downwardly facing vertically movable compression ram in the chamber, an upwardly facing vertically movable gate ram forming the lower end of the chamber during compression, and a bale-strapping assembly associated with the lower end portion of the chamber. A horizontally movable door operating between open and closed positions at the inner end of the feed chute forms part of the wall of the chamber when closed. The leading edge of the door is specially shaped to penetrate the material in the chute and to cooperate with anvil surfaces at the end of its travel to prevent jamming of the door as it closes.

1 Claim, 6 Drawing Figures

20
40
42
10
13
13
14
43
36
32
49
12
A
45
47
46
13
45
16
C
24
44
B
26
28
30
18
18
22

38
5
CLOSE
54
60
62
10°
36
58
64
68
34
66
70
5

38
56
54
58
60
36
64
62
13
120°
30°
34
68
76
78
13
72
32
70
74
80

VERTICAL CLOSED CHAMBER BALER

This is a division, of application Ser. No. 717.872 filed Aug. 26, 1976, now U.S. Pat. No. 4,102,259.

This invention relates to automatic baling presses and in particular to an improved arrangement of parts in baling presses having the compression chamber and the bale-strapping elements disposed between upper and lower rams.

BACKGROUND

At the present time various particulate combustible materials, such as wood chips, bark, chipped tree tops, wood waste and cotton gin waste, are baled to reduce their volume and to thereby lower transportation costs. The baled material can be stored outside without appreciable deterioration and can be used as fuel, for example, boiler fuel in power plants. Green bark, green chipped tree tops and wet peanut shells dry out rapidly after baling, whereas they do not dry out in loose form in outdoor storage and therefore deteriorate.

A variety of baling presses for compressing material into bales and for automatically tying or strapping the bales are known. In general, these machines comprise a compression chamber in which one or more platens are moved by hydraulic pistons in order to compress the material, together with a tying or strapping mechanism which inserts wires or straps between the bale and each of two opposed platens.

SUMMARY OF THE INVENTION

In accordance with one feature of the present invention there is provided a baling press having a vertical compression chamber, a vertically reciprocating upper compression ram which moves downwardly in the chamber during a compression stroke, an inclined feed chute having an inner and adapted to communicate with the chamber when the compression ram has been raised, a sliding door adapted to open and close the opening between the inner end of the chute and the chamber, a vertical reciprocating lower gate ram forming the bottom wall of the chamber, and means for applying strapping wires or the like to the compressed material while the same is held in a compressed state between the upper and lower rams. In operation of the machine the sliding door is opened when the upper ram is in a raised position so that particulate material may be fed into the compression chamber below the upper ram. The door closes, and the upper ram then moves downwardly toward the lower ram which has previously been moved to its raised position. When processing wood chips maximum compression is maintained for a short period to express an expressable liquid in the material following which the upper ram moves slightly upwardly to permit the strapping operation to be effected. When processing other materials such as bark no dwell time is employed and it may be desirable to retract the upper ram, feed in, and compress a second charge of material before strapping. After strapping has been accomplished the lower ram moves down allowing the bale to move down and out of the lower end of the compression chamber. A horizontal ejector ram then moves the bale off the lower ram. It has been found that for the types of material referred to above it is possible to obtain a greater bale density and improved integrity and stability of the bales with the vertical compression chamber than with a horizontal chamber using the same compacting pressure on a horizontal ram.

According to another feature of the invention there is provided in a vertical chamber baling press an inclined feed chute and sliding door arrangement which reduces jamming of the door during closing thereof. The door has a relatively sharp leading edge inclined with respect to the direction of door travel for penetrating particulate material so as to penetrate through a mass of material in the lower end of the chute, and the door mounting includes a frame in which the door edge seats when closed. One of the surfaces of the door edge forms a shoulder which cooperates with an anvil shoulder on the frame for shearing particulate material which tends to wedge between the door edge and the frame as the edge enters the frame.

DETAILED DESCRIPTION OF EXEMPLARY EMBODIMENT

The invention will be further understood from the following detailed description of an exemplary embodiment taken with the drawings in which.

Figure 1:
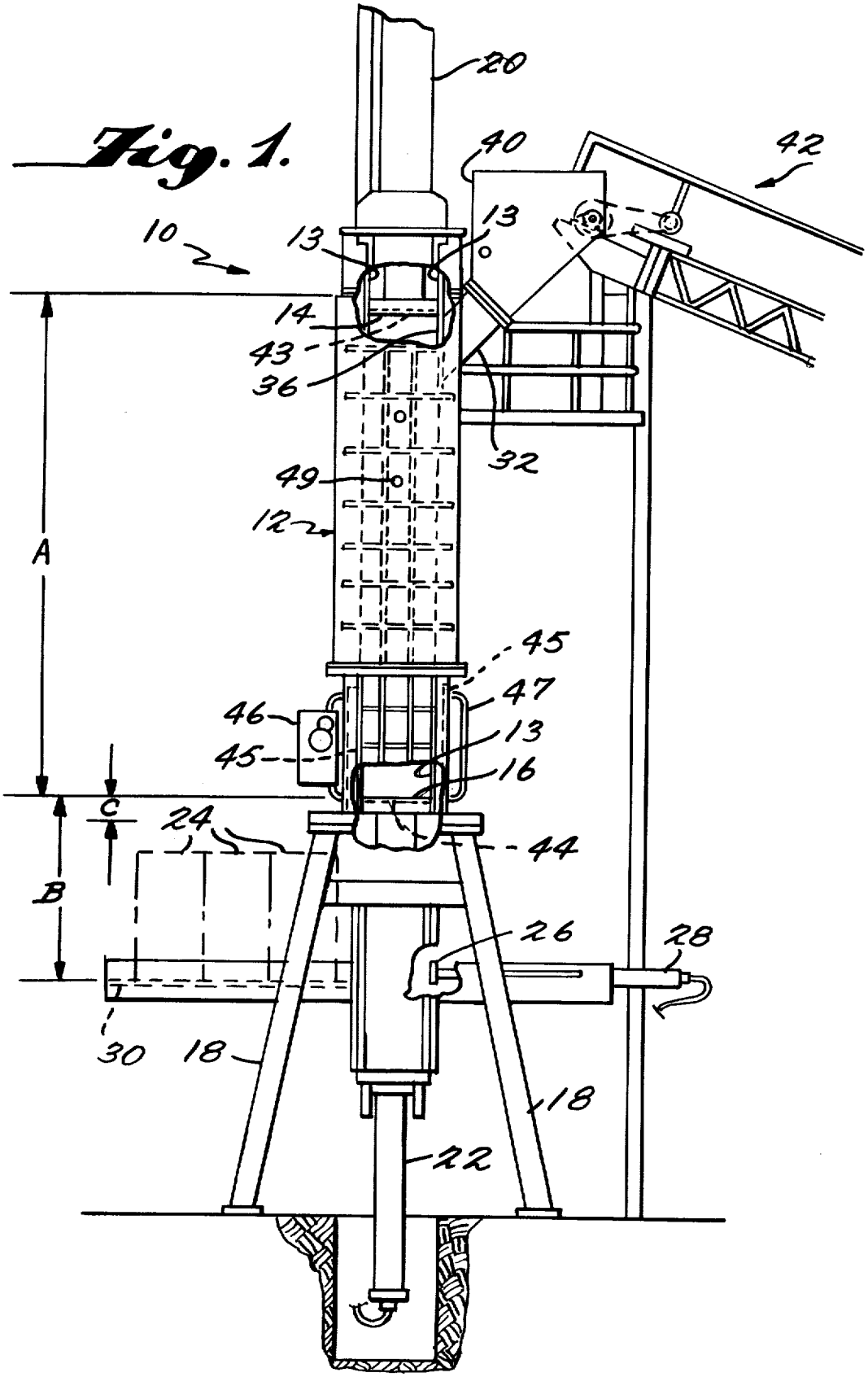
FIG. 1 is a schematic elevational view of a baling press embodying the principles of the present invention.
Figure 2:
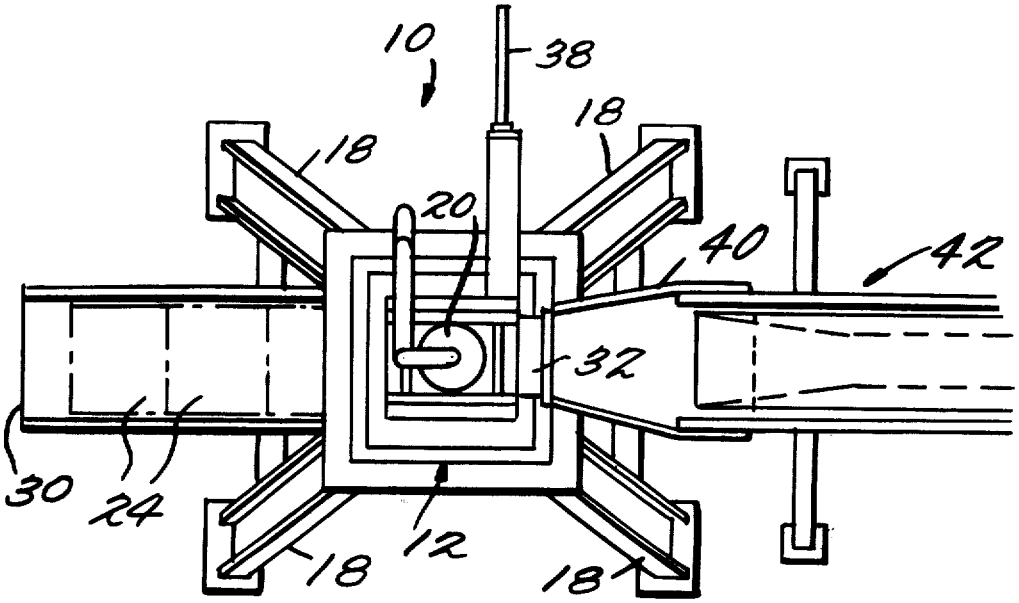
FIG. 2 is a schematic plan view of the baling press of FIG. 1.

Referring to FIG. 1 there is shown schematically an automatic baling press 10 comprising a vertically elongated compression box or chamber 12 having an internal vertical dimension A defined between the lower surface of an upper compression ram 14 and the upper surface of a lower gate ram 16. The compression box 12 is laterally enclosed throughout its length by side walls 13 and is mounted on the upper ends of ground-engaging legs 18 such that the lower end of the box 12 is disposed well above ground level. The compression ram 14, which is shown in its raised position, has a vertical stroke equal to dimension A plus dimension C for ejection, the stroke being imparted by a vertical hydraulic cylinder 20 mounted above the compression box 12. The gate ram 16, which is also shown in its raised position, has a vertical stroke equal to dimension B, the stroke being imparted by a vertical hydraulic cylinder 22 mounted below the compression box 12 and between the legs 18. The gate ram 16 remains in its raised position during a compression stroke of the compression ram 14. When compaction of the material in the compression box 12 is complete, both the compression ram and the gate ram 16 move down relative to the compression box 12 so as to remove from the lower end of the box 12 a compressed bale 24 of the material which was previously placed in the box 12.

A horizontal ejector ram 26 is disposed at the elevation of the gate ram 16 when the latter is in its retracted position. The ram 26 is reciprocated by a hydraulic cylinder 28 which is supported by the gate ram cylinder mount. In its retracted position, as shown, the ram 26 is disposed just to the right of the path of travel of the gate ram 16 and in its extended position the ram 26 is disposed just to the left of the path of travel of the gate ram 16 so as to push the just-formed bale 24 on to a floor 30 or other receiving surface.

An inclined feed chute 32 is rigidly fixed to the side wall 13 of the compression box 12 at the upper end of the latter. The lower end of the chute 32 terminates at an aperture 34 (see, e.g. FIGS. 4 and 5) located in the side wall 13 just below the compression ram 14 when in its upper position. A horizontally slidable door 36 is actuated by a hydraulic cylinder 38 (see, e.g. FIGS 4 and 5). The upper end of the chute 32 communicates with the lower end of a fixed hopper 40. The material which is to be compressed and baled is delivered to the hopper 40 in any convenient manner, as by means of a conveyor 42.

The lower end portion of the compression box 12, that is the portion of the box 12 between the compression ram 14 and the gate ram 16 at the end of a compacting operation, functions as a baling chamber. To this end there is provided a strapper mechanism 46 which in operation encircles the mass of material compacted between the rams 14 and 16 with wires or straps each of which tightly engages the top and bottom of the compacted mass. In order to permit the wires to be passed around the compacted material the compression ram 14, the gate ram 16 and two opposed portions of the baling chamber side wall 13 are provided with slots. In FIG 1 the slots in the rams 14 and 16 are illustrated at 43 and 44 respectively, and the slots in the two opposed side wall portions are illustrated at 45. The power-driven strapper mechanism 46 in conjunction with wire guides 47 passes the baling wires through the slots 43, 44 and 45 and into engagement with the compacted material. For purposes of the present invention the strapper mechanism 46, including the slots 43, 44 and 45, and the guides 47 may be of known construction. The slots 45 serve a further useful purpose in the baling of material containing liquid which is expressed during compaction, because they permit the expressed liquid to escape from the baling chamber. Subsequent insertion of the baling wires through the slots 45 removes any material which may have been forced in during compaction, thereby clearing the slots once each cycle. U.S. Pat. No. 3,929,062 fully discloses a baling system which may be employed in the present apparatus, and the disclosure of this patent is incorporated herein by reference.

Figure 6:
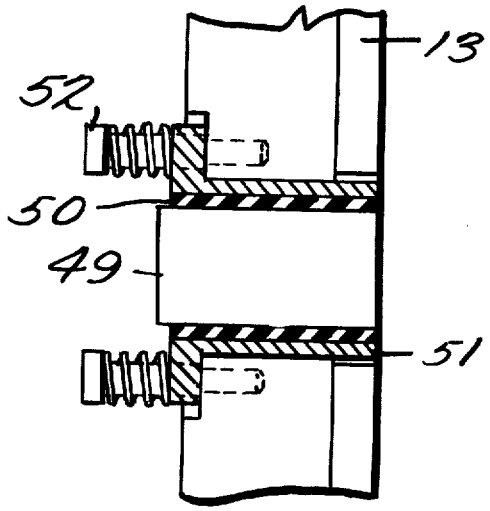
FIG. 6 is a fragmentary sectional view of a mounting in the compression chamber wall for receiving a level sensor.

A level sensor 49, which may be of conventional construction is provided in the side wall 13 of the compression box 12 at a location below the lower end of the feed chute 32. The sensor 49 generates an electrical signal when the level of material being poured into the box 12 during loading reaches the sensor. The signal may be employed as a guide during manual control of the baling operation or it may be employed in an automatic control system which stops conveyor 42, closes the compression box door 36 by admitting pressure to the cylinder 38 and then initiates the desired sequencing of the rams 14, 16, 26 and of the other components. As seen in FIG. 6, the sensor 49 is disposed in a resilient sleeve 50 carried in the flanged tubular mounting member 51 which is secured to the compression box side wall 13 by bolts 52.

Figure 3:
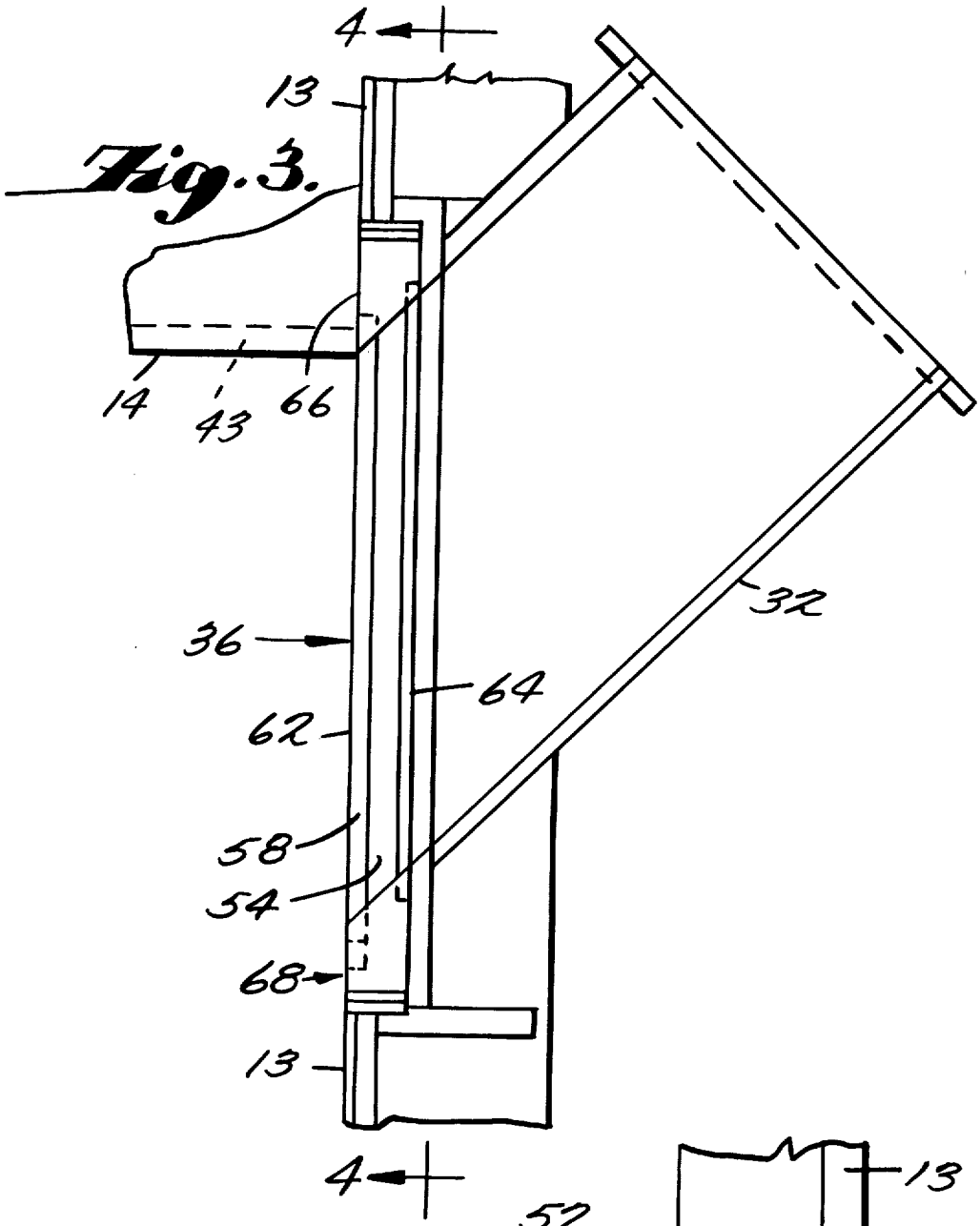
FIG. 3 is a fragmentary elevational view, on an enlarged scale, of the feed chute.
Figure 4:
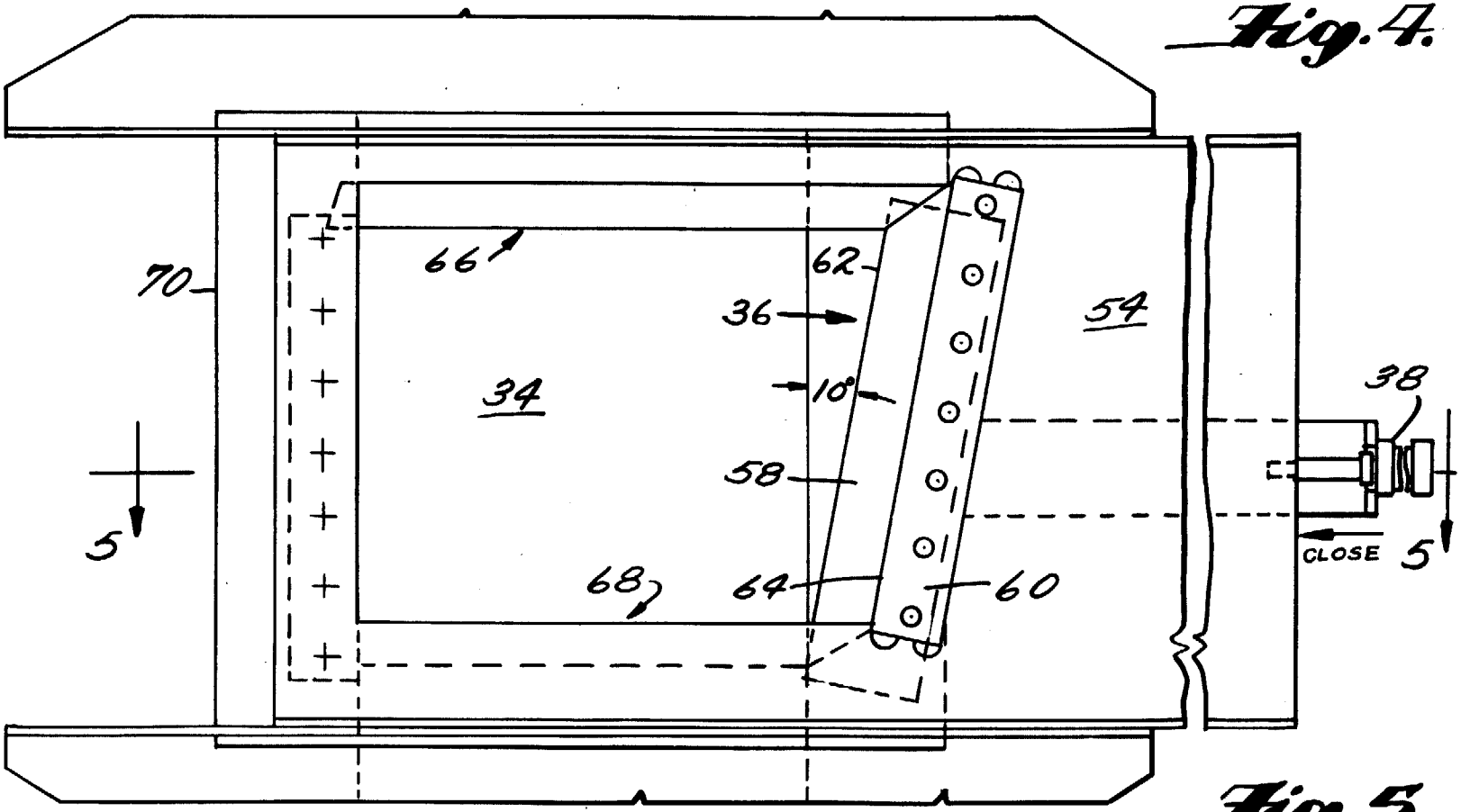
FIG. 4 is a sectional view taken on the line 4—4 of FIG. 3.
Figure 5:
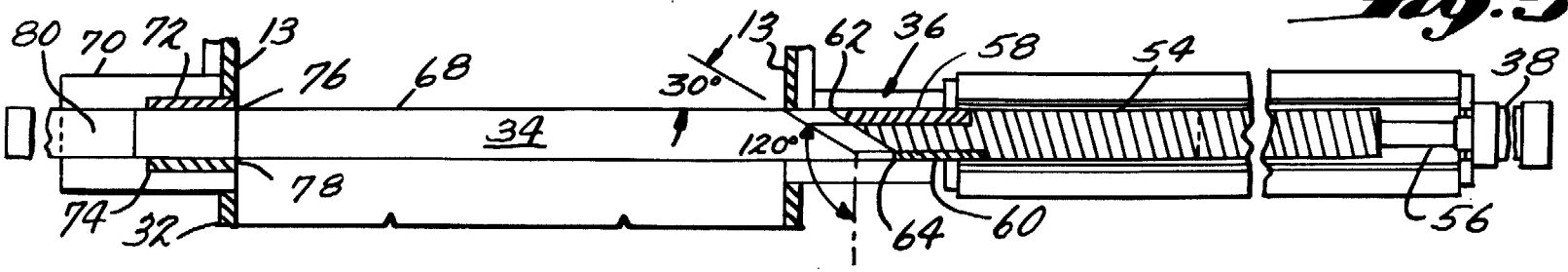
FIG. 5 is a sectional view taken on the line 5—5 of FIG. 4.

FIGS. 3, 4 and 5 illustrate the construction of the compression box door 36 which is an important feature of the invention. In these figures the hydraulic cylinder 38 is in a retracted position with the result that the door 36 is in an open position. The door 36 is constructed of a steel body plate 54 having its rearward edge attached to the piston rod 56 of the hydraulic cylinder 38. A cutting plate 58 is fitted into a groove machined in the inner face of the forward edge of the body plate 54, and a shear plate 60 is similarly fitted into a groove machined into the outer face of the body plate 54. By inner face is meant the surface facing into the compression box 12 and by outer face is meant the surface facing into the feed chute. By forward edge is meant the edge which forces its way through material in the chute during closing of the door 36. Both plates 58 and 60 are rigidly secured to the body plate by screws.

As seen in FIG. 4 the forward edge of the door 36 is inclined upwardly and rearwardly at an angle of about 10° from the vertical. As seen in FIG. 5 the forward edge is also shaped to provide a leading knife portion for cutting through material during closing movement of the door 36 and to provide a trailing shear portion to shear stringy material which might otherwise tend to jam the door 36 as it reaches its fully closed position. The leading knife portion is formed by shaping the forward edges of the cutting plate 58 and the body plate 54 to form a V-shaped structure when viewed in horizontal cross section, the leading sharp edge 62 of the knife portion being coplanar with the inner surface of the door 36. The trailing shear portion of the forward edge of the door 36 is formed by the shear plate 60 the forward surface of which lies in a plane which intersects the plane of the knife surface at an angle of 120° so as to present an abrupt shoulder 64. When viewed in horizontal cross section the shoulder 64 is a 90° corner.

The upper and lower edges of the compression box door 36 are slidably guided by legs 66 and 68. As the door approaches its fully closed position the forward edge of the door enters a vertical frame 70 the sides of which are provided with inner and outer fixed anvil plates 72 and 74. The anvil plates have sharp 90° shoulders 76 and 78 which together with the knife edge 62 and the shoulder 64 on the leading edge of the door 36 form two pairs of shearing surfaces during final closing movement of the door 36.

Operation

A cycle begins with the compression box 12 empty, the compression ram 14 and the gate ram 16 are in their up positions and the compression box door 36 is open. Material to be baled is loaded into the feed chute 32 from the conveyor 42 and the hopper 40 until the level sensor 49 generates a signal indicating that the upper surface of the material has reached its highest elevation. The door 36 is moved to the left as viewed in FIGS. 4 and 5, by applying hydraulic pressure to the door cylinder 38, so as to close the aperture 34 between the chute 32 and the interior of the compression box. In the closed position the inner surface of the door 36 is flush with and forms part of the side wall 13 of the compression box.

The compression ram 14 then moves down, compacting the material in the compression box 12 until a predetermined maximum pressure, e.g. 2400 psi, is built up in the compression ram cylinder 20. Holding pressure is maintained in the gate ram cylinder 22 to hold the gate ram 16 in its up position during the compression stroke of the ram 14. If the material being compressed is liquid-containing, such as wood chips are likely to be, the compression ram 14 dwells at maximum hydraulic pressure for a short time, for example 15 seconds, to express liquid from the material. The expressed liquid flows out of the compression box 12 through the wire slots 45 in the side wall of the box. Then the hydraulic pressure in the compression ram cylinder 20 is reversed so that the compression ram 14 moves up at short distance to the appropriate position for strapping. If the material being compacted is more compressible and liquid-free, such as bark, the dwell stage is omitted and the compression ram 14 is moved to its full up position so that a second charge of material can be added to the compression box 12 by way of the chute 32. The ram 14 then moves down again to its strapping position and remains there while the strapper mechanism places the baling wires around the bale 24.

After the strapping operation has been completed, the pressure in the gate ram cylinder 22 is reduced and ejection pressure is applied in the compression ram cylinder 20. The rams 14 and 16 therefore move down with the freshly strapped bale still longitudinally compressed between them. This movement continues until the gate ram 16 reaches the level of the floor 30 at which time the bale is free of the compression box side wall 13 and longitudinal bale expansion tensions the bale wires. Pressure in the compression ram cylinder 22 is then reversed so as to move the compression ram 14 upwardly away from the bale. The ejector ram cylinder 28 is then pressurized so as to move the ejector ram 26 to the left, pushing the freshly strapped bale clear of the ram 16. The rams 14 and 16 then move to their full up positions, and the compression box door 36 is moved to its open position by the cylinder 38, completing one baling cycle.

The above sequence of steps can be carried out automatically or by an operator who manually controls the various hydraulic cylinders.

Referring more specifically to the operation of the compression box door 36 it will be seen from FIGS. 4 and 5 that as the door 36 moves to the left toward its closed position the knife edge 62 on the cutting plate 58 precedes the remainder of the forward edge of the door 36. The knife edge 62 thereby moves cleanly through the wood chips, bark or the like pushing the latter toward the chute 32. As the forward edge of the door 36 begins to enter vertical frame 70 the knife edge 62 slides past the sharp shoulder 76 on the inner anvil plate 72 thereby shearing any particles which would tend to wedge bwtween the anvil plate 72 and the inner surface of the cutting plate 58. Since the cutting plate is inclined upwardly and to the right as seen in FIG. 4 shearing occurs at a point which begins at the bottom of the anvil shoulder 76 and travels up along this shoulder as the cutting plate 58 enters the vertical frame 70. If the entire forward edge of the door 36 was one continuous V-shaped knife edge, the trailing portion of that edge would tend to drag material into the vertical frame 70 where it would wedge between the outer anvil plate 74 and the outer surface of the door 36. The presence of the sharp shoulder 64 or its equivalent and the anvil shoulder 78 in the door construction of this invention provides a shearing action at the trailing portion of the forward edge of the door so that material is sheared during final closing movement of the door 36. This reduces or prevents the tendency of stringy material such as bark to jam the door 36 by wedging between the outer surface of the door and the outer wall of the vertical frame 70. Only a small amount of material enters the frame 70 and this is pushed out of the space 34 through a slot 80.

What is claimed is:

1. In a machine for compressing particulate matter to form bales, said machine having a compression chamber forms by an enclosing side wall and end walls, at least one of said end walls being a movable ram, and a feed inlet chute having an inner end adjacent a feed aperture in the chamber side wall and an outer end into which particulate material can be delivered, the improvement which comprises a door slidable in its own plane, at the inner end of the chute, between a closed position in which the feed aperture is blocked and an open position, said door having a thickness defined by inner and outer surfaces which in the closed position of the door face toward and away from the chamber, respectively, said door having an edge which penetrates through a mass of particulate material residing in said chute and which seats in a frame as said door moves from an open position to a closed position, said edge having a relatively sharp inclined leading portion for penetration through the particulate material and an abrupt shoulder portion formed by at least one of said door surfaces and facing in the direction of movement of said door during closing, said shoulder portion cooperating with an anvil shoulder located at said frame for shearing particulate material which tends to wedge between said door edge and said frame as said edge enters said frame.

* * * * *